US009149707B2

(12) United States Patent
Cochran

(10) Patent No.: US 9,149,707 B2
(45) Date of Patent: Oct. 6, 2015

(54) BALL HITTING TEACHER

(71) Applicant: Hayden Alexander Cochran, Washington, DC (US)

(72) Inventor: Hayden Alexander Cochran, Washington, DC (US)

( * ) Notice: Subject to any disclaimer, the term of this patent is extended or adjusted under 35 U.S.C. 154(b) by 66 days.

(21) Appl. No.: 14/083,961

(22) Filed: Nov. 19, 2013

(65) Prior Publication Data

US 2015/0141173 A1 May 21, 2015

(51) Int. Cl.
*A63B 69/00* (2006.01)
*A63B 69/38* (2006.01)

(52) U.S. Cl.
CPC ..... *A63B 69/38* (2013.01); *A63B 69/0091* (2013.01)

(58) Field of Classification Search
USPC ..... 473/417, 427, 429, 430, 431, 434–438
See application file for complete search history.

(56) References Cited

U.S. PATENT DOCUMENTS 2,272,765 A * 2/1942 Beeson et al. ..... 473/417
2,578,313 A * 12/1951 Moseley ..... 473/426
2,818,255 A * 12/1957 Ponza ..... 473/429
3,876,203 A * 4/1975 Gold ..... 473/417
5,685,542 A * 11/1997 Weis ..... 473/459
5,772,536 A * 6/1998 Wang ..... 473/417
6,551,204 B1 * 4/2003 Di Re ..... 473/417
6,659,891 B2 * 12/2003 Lloyd ..... 473/429
2007/0054756 A1 * 3/2007 Hanson et al. ..... 473/451
2009/0137349 A1 * 5/2009 Alekseev ..... 473/436
2015/0141173 A1 * 5/2015 Cochran ..... 473/436

* cited by examiner

*Primary Examiner* — Gene Kim
*Assistant Examiner* — M Chambers

(57) ABSTRACT

The tool includes a rigid base with an upright rigid post attached perpendicularly to the base a rigid form fitted outer sleeve, measured to fit snug over the upright post. This sleeve allows for height adjustability, also includes a uniquely formed and rigid wand, with a measured, weighted counter-balance end with a small hole to accommodate a bungee cord attachment and on the other end a set and re-settable fix tennis ball mounting the tennis ball itself is mounted on a spindle on a small rod which allows free rotation of the ball for the purpose of ball striking muscle memory development, the ball-mounting wand is bent, geniculate and curved into a question mark like configuration using holes and peg attach the wand to the crown of the form fitted outer sleeve using the counterbalance and the bungee cord the ball can be repeatedly struck, displaced and self-reset.

7 Claims, 6 Drawing Sheets

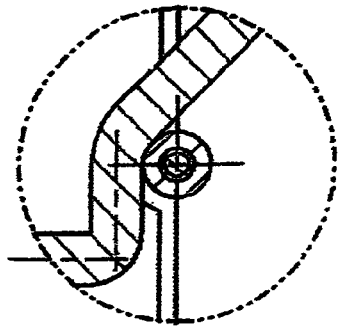
FIG. 10
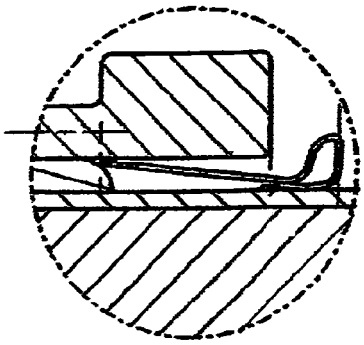
FIG. 10
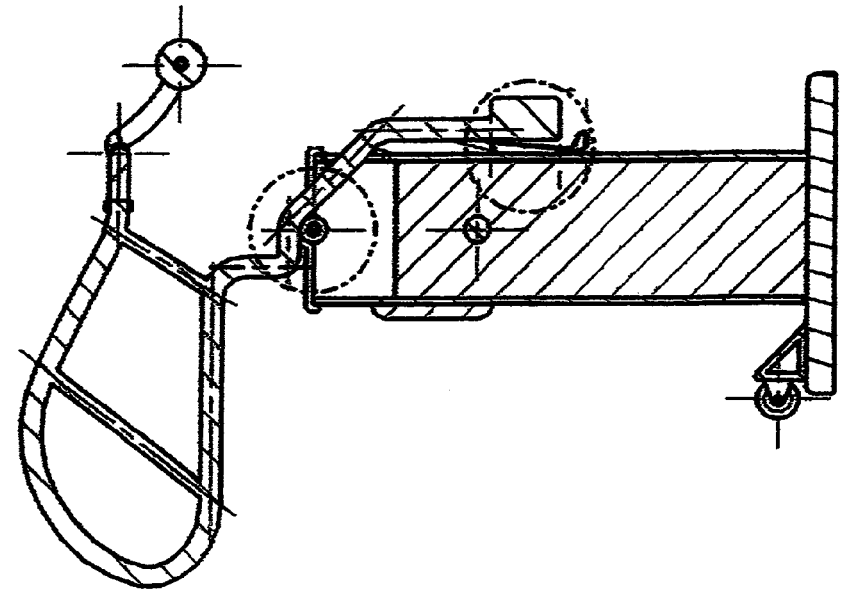
FIG. 11
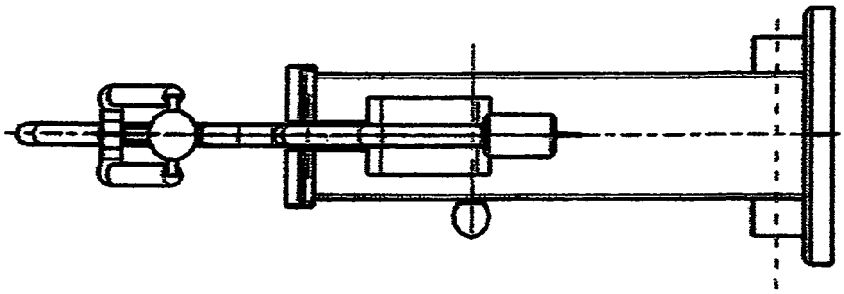

BALL HITTING TEACHER

BRIEF SUMMARY

Field of the Invention

The present invention relates to a ball striking teaching tool and more particularly to a tool that provides an instantly self-resetting movable and displaceable yet secured ball, to facilitate the opportunity for the practicing individual to hit hundreds of more practice balls than the practicing individual would be able to accomplish during the course of a standard tennis practice session and by doing so promote improved ball striking by repeated simulation of proper ball stroke and striking form. Thus improving stroke proficiency by improving the practicing individual's muscle memory, eye hand coordination and the muscle strength within the specific muscle groups that, most involve ball striking proficiency.

OBJECT OF THE PRESENT INVENTION

It is an object of the present invention to provide a lightweight, portable but stabilized ball striking practice device.

It is a further object of the present invention to provide such an apparatus which will enable striking of a ball while still or in motion so as to enhance eye hand coordination.

It is a further object of the present invention to provide a device which will be readily adaptable to simulate game or practice conditions.

It is yet a further object of the present invention to provide a device usable by physically challenged individuals such as someone confined to a wheelchair.

BACKGROUND OF THE INVENTION

This invention relates to a tool designed for practicing and helping with the teaching of proper ball hitting technique as in baseball and or proper stroking technique as in tennis.

Over the years many devices have been developed in an attempt to provide the necessary benefit and feature of striking a target ball that has the feel of stroking a free and live, yet controlled tennis ball that instantly self resets itself to a predetermined position.

Ball striking practice devices are well known in the prior art. Of particular reference are three practice devices U.S. Pat. No. 4,079,934 of Nixon issued Mar. 21, 1978, U.S. Pat. No. 4,003,572 of Harvey issued Jan. 18, 1977, U.S. Pat. No. 4,216,960 of Nicholls issued Aug. 12, 1980.

The common drawback of each of these noted and issued patents, are obvious, the ball can't be struck using a standard driving forehand or backhand tennis stroke and at the same time, not have the racket become disruptively entangled with the ball tethering mechanism of the device.

Tennis is a sport that calls for hitting a moving target, in tennis the moving target unit is the tennis ball, proficiency at hitting a moving target unit is best accomplished by first learning to be proficient and consistent at hitting a still or stationary target unit sighting as an example the marksman who has become a champion marksman whom, without a doubt began by becoming proficient and consistent at hitting a stationary or still target before improving and graduating to a moving target.

Other references of general background interest describing and illustrating ball striking practice devices include. U.S. Pat. No. 2,578,313 of Moseley issued Dec. 11, 1951, U.S. Pat. No. 3,876,203 of Gold issued Apr. 8, 1975, U.S. Pat. No. 3,794,320 of Salmont issued Feb. 26, 1974, U.S. Pat. No. 4,204,678 of Weis issued May 27, 1980, U.S. Pat. No. 4,417,730 Weiner issued Nov. 29, 1983, U.S. Pat. No. 4,508,340 of Liao issued Apr. 2, 1985, U.S. Pat. No. 2,713,487 of Jaediker issued July 1955, U.S. Pat. No. 3,731,926 of Vincent issued May 1973, U.S. Pat. No. 4,042,237 of Moraru issued August 1977, U.S. Pat. No. 4,089,521 of Berst et al. issued May 1978.

DETAILED DESCRIPTION

Detailed Description of the Preferred Embodiments

Now referring to FIG. 1 there is illustrated a ball striking practice tool particularly adapted to tennis in accordance with the present invention includes an anti-skid material (1) such as rubber may be provided as a foundation for the base (2) as illustrated. The base (2) should be of, sufficient weight and mass necessary for stable support of the rigid up-right post FIG. 6. FIG. 6 illustrates a rigid rectangular upright post that must be attached and fixed on end, to the top side of the base illustrated as (3) in FIG. 1

While the base has been shown as being in the shape of a pentagon it should be understood that other shapes may be submitted (so long as) the alternative shapes are within the purview of the present invention.

Additionally in FIG. 6 is a through hole (1) drilled through the sides of the rigid up-right post illustrated in FIG. 6. The through hole (1) is sufficient to make use of a through peg (2).

Referring now to FIG. 7, which illustrates a hollow, rectangular and upright sleeve. Hollow so as to receive the rigid upright post FIG. 6. In addition the rigid, hollow upright sleeve FIG. 7 is measured so as to have an inner circumference roughly the equivalent of the outer circumference of the rigid upright post FIG. 6. So as to bring about a snug fitting, easy sliding motion between the outer sleeve FIG. 7 and the rigid upright post FIG. 6.

As a further description of the rigid upright outer fitting sleeve FIG. 7 there are through holes (1A),(1B),(1C) drilled through the sides of the easy sliding sleeve FIG. 7, these appropriate through holes (1A),(1B),(1C), along with the appropriate through hole of the upright post (1) and peg (2) of FIG. 6 will be the means by which the present invention is made height adjusted in regards to the playing surface.

With the exception of the non-skid material forming the foundation (1) for the base (2) of FIG. 1, the preferred constructing material would be a type of moldable plastic such as a, high or low density polyurethane which is lightweight and moldable, then can be made hard set and rigid.

The wand will now be described with reference to FIG. 1. The wand (2) is a single piece of linear piping that has been molded, curved, bent and geniculated so as to appropriately fit the needs of the present invention. The curved, bent and geniculated wand (2) will have a roughly similar appearance to a question mark with a slightly elongated tail. The wand (2) now must be rigid and stabilized. Stabilization is increased by the use of stabilizer slats (3A) and (3B) which are interconnected to the over and under lengths of the rigid bent and geniculated wand (2). In addition the wand (2) is fitted with a detachable Y-shaped target unit ball mounting (4). The Y-shaped target unit ball mounting, (4) will mounts a mounted ball (9) that is set on a spindle (5) that is received onto a small through rod (through rod not illustrated) that is fixed and set in such a manner as to allow the target unit ball (9) to spin freely on an axis. The Y-shaped target unit ball mounting (4) can be twisted so as to change the axis upon which the target unit ball (9) spends which would allow the practicing individual to simulate and practice different types of spin, slice or cut shots. For ball (9) striking practice the wand (2) will be mounted in the crown of the height adjusting sleeve FIG. 7) by use of a single through peg (2) of FIG. 6 and a appropriate through holes (2A), (2B) at the crown of the adjustable sleeve FIG. 7 the wand (2) of FIG. 1 will be allowed to teeter freely along a longitudinal direction.

The full range of the free swinging wand (2) will begins at a predetermined set position illustrated in FIG. 1 and extends all the way to a predetermined fully displaced position FIG. 4. The full range of the displaced wand is best illustrated by a comparison of FIG. 3 and FIG. 4. In the set position when the target unit ball (9) of FIG. 1 is struck by a tennis racket the target unit ball (9), the Y-shaped ball mounting unit FIG. 9 and the upper portion of the wand (2) of FIG. 1 all move generally upward and away from the striking tennis racket. The generally upward and away movement of the target unit ball (9) and wand (2) of FIG. 1 Functions to simulate a struck tennis ball in free or unencumbered movement.

FIG. 2, in the displaced position the wand (1) instantly self-rebound and re-set by making use of the combined resistance and restoring force of the counterbalance (4) of FIG. 2 and the full engaged bungee cord (3). The bungee cord (3) will be attached on one end near the end of the wand (1) at the head of the counterbalance (4) with the other end of the bungee cord (3) being attached to the center, front side of the height adjustable sleeve. Both ends of the bungee cord (3) are secured yet detachable by means of hooks or holes. FIG. 2 best illustrates the fully displaced wand (1) and the full engaged bungee cord (3). The counterbalance weight (4) and the bungee cord (3) will be the means by which the target the unit ball (5) of FIG. 2 and wand (1) will return to the full reset position.

By varying the length of the bungee cord (3) of FIG. 2 a variety of ball return velocities can be achieved, thus allowing the practicing individual to practice the striking of incoming balls in rapid repeated fashion before the ball (5) returns to the fully set position. By making use of longer bungee cords the practicing individual can practice striking incoming balls at optionally decreased velocities.

By making use of the benefits and features of the present invention the practicing individual will be allowed to practice tennis strokes at a variety of heights, a variety of incoming velocities and in addition the practicing individual will be allowed to practice a variety of shots such as flat shots, spin shots, chop shots and slice shots.

The ability of the present invention to simulate a number of varied tennis shots will help to improve the tennis game of both new and advanced tennis players, and in addition the present invention readily lends itself to a method of practical and economic training for the tennis practicing individual. For example a number of the present inventions could be placed, located and situated in desired positions on, and or around a tennis court such as near the baseline or near the net or intermediate thereof or near the sidelines to simulate a series of ball strikes in a continuing ball striking simulation.

Thus the tennis practicing individual would be able to move practicing proper footwork from apparatus to apparatus along a particular route that has been arranged to simulate the various movements and shots that will arise for a tennis player during an actual tennis match. The practicing individual will also be allowed to practice a type of shot at each location in a continuing circuit, in this manner, a number of practicing individuals such as in a high school or college tennis team or individuals in a tennis aerobics class could quickly and efficiently practice an appropriate ball striking and at the same time practice the tennis appropriate, specialized footwork.

An additional benefit of the present invention is the fact that footwork and tennis stroke practice can be achieved an area significantly smaller than a tennis court.

Although the preferred embodiments and materials have been described and explained, it should be understood that various changes, adaptations and modifications may possibly be made therein without departing from the spirit, scope and appended claims of the present invention.

SUMMARY OF THE INVENTION

The present invention comprises a set and self-re-settable, stationary or moving target-unit ball striking device, primarily for practicing or teaching of ball striking within a ball striking sports such as in baseball and more specifically such as in tennis, in which a rigid base perpendicularly supports a rigid and by design, unmoving upright post the rigid upright post is now fitted with a rigid and measured to fit snug, outer sleeve with, appropriate and exacting matching holes drilled through the snug fitting outer sleeve and upright post these matching holes used in combination with a removable through peg will serve to provide height adjustability to the device, the aforementioned target unit ball will be mounted at the head of a wand, said wand has been bent curved and geniculated into a shape that greatly resembles the bends, curves and general shape of a "question mark" (?). At the opposite end of the wand, away the head of the wand will be a specifically weighted counterbalance connected to the wand's tail end, a hook will be provided near the end of the wand to accommodate the connecting of one end of a bungee cord that will work in cooperation with the specifically weighted counterbalance to re-bound and re-set the device, wherein the ball mounting end of the wand is now almost directly above the weighted counterbalance and bungee corded configured end of the wand, The wand will now be appropriately mounted in the crown of the snug fitting height adjusting sleeve, by the use of a through pivot peg and a set of measured holes drilled through the crown of the snug fitting height adjusting sleeve. A rigid Y-shaped ball mounting, using a spindle and a small rod will allow the target unit ball to spin along an axis in a manner that resembles a ball struck with the intentions of producing topspin, in addition the Y-shaped ball mounting itself can be twisted in such a way to produce a different angled axis allowing the practicing individual to practice different types of slice, chop cut and spin strokes.

When the set target unit ball is struck in particular with a baseball bat or tennis racket the ball the spindle the Y-shaped ball mounting and the wand are all displaced and will move generally upward and away from the striking bat or racket. The uniquely bent and curved configured wand will instantly self-rebound from the displaced position to the original predetermined set position.

An additional advantage in regards to the present invention will be the use of varying lengths and resistant strengths of the said bungee cords. In the instantly self-rebounding process varying of the length and resistant strength of said bungee cords will produce a variety of instantly self-rebounding resistance, speed and velocity choices. These variations of rebounding resistance and velocity speed choices can, in a practice session simulate the varieties of speeds and velocities a tennis player will encounter in the playing of an actual tennis game. And therefore causing the player to be better prepared and more proficient during a tennis match.

Another additional feature in regard to the present invention is that, by the use of this invention a practicing individual can strengthen the specific muscle groups and muscle memory that goes hand-in-hand with improved batting and tennis stroke development.

BRIEF DESCRIPTION OF THE DRAWINGS

These and other objects, advantages and novel features of the present invention will become more apparent upon reading the following detailed description and upon referring to the drawings in which:

FIG. 10. Is a front full forward view of the present invention in the full set and ready for striking position.

FIG. 11. Is a full side view of the present invention with circled and particularly noted appropriately weighted counterbalance.

FIG. 12. Is a full, side and blown up view of the appropriately weighted end of wand connected counterbalance and bungee cord in the full at rest and set and ready for striking position.

Figure 2:
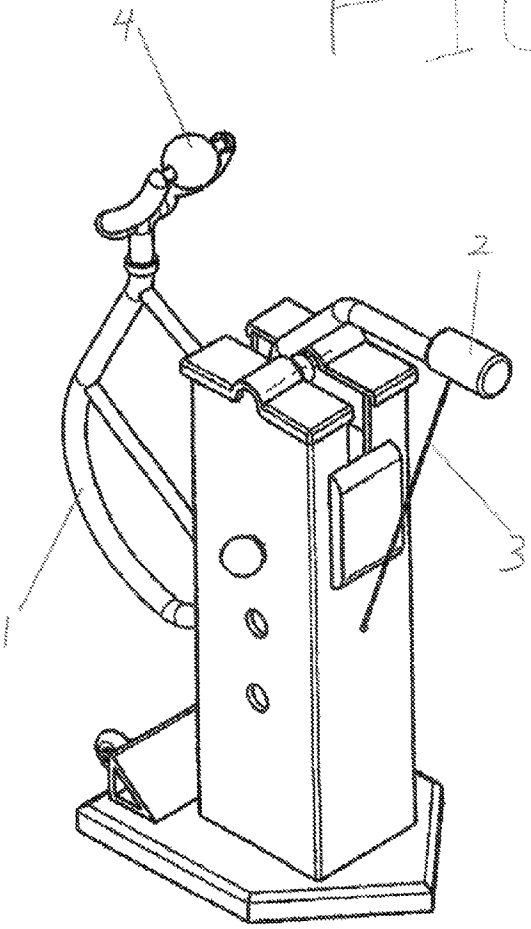
FIG. 2. Is a forward oblique and elevated view of the present invention in the fully displaced position.
Figure 1:
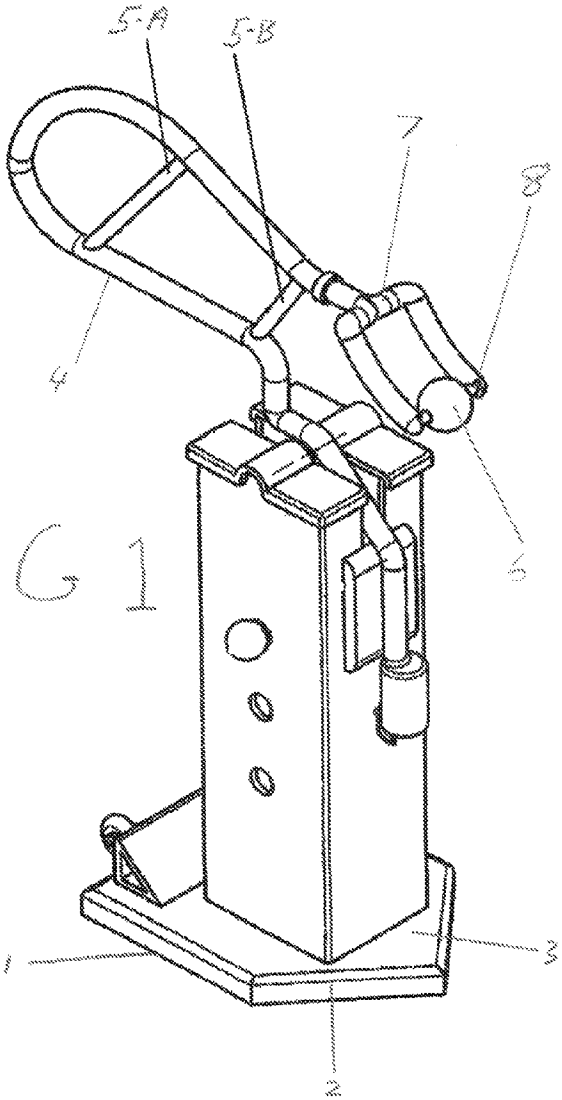
FIG. 1. Is a forward oblique and elevated view of the present invention in the fully set and ready for striking position.
Figure 4:
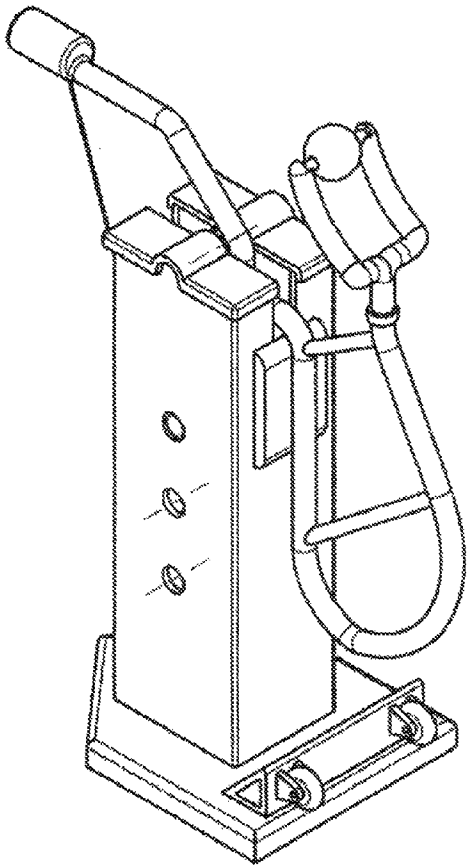
FIG. 4. Is a rear oblique and elevated view of the present invention in the fully displaced position.
Figure 3:
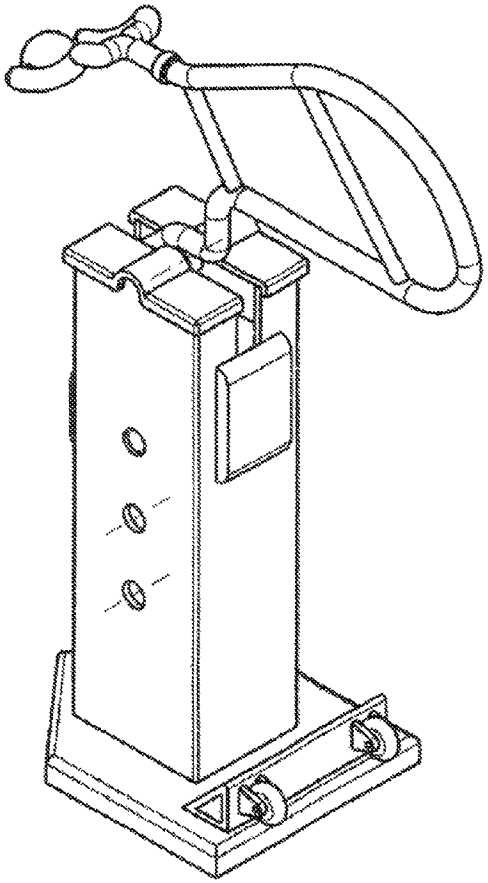
FIG. 3. Is a rear oblique and elevated view of the present invention in the fully set and ready for striking position.
Figure 6:
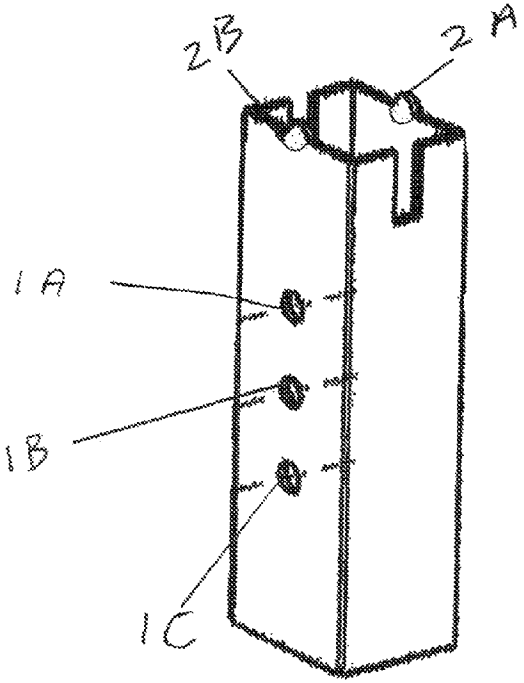
FIG. 6. Is an oblique and elevated view of the present invention's rigid, made to fit snug, height adjusting sleeve.
Figure 5:
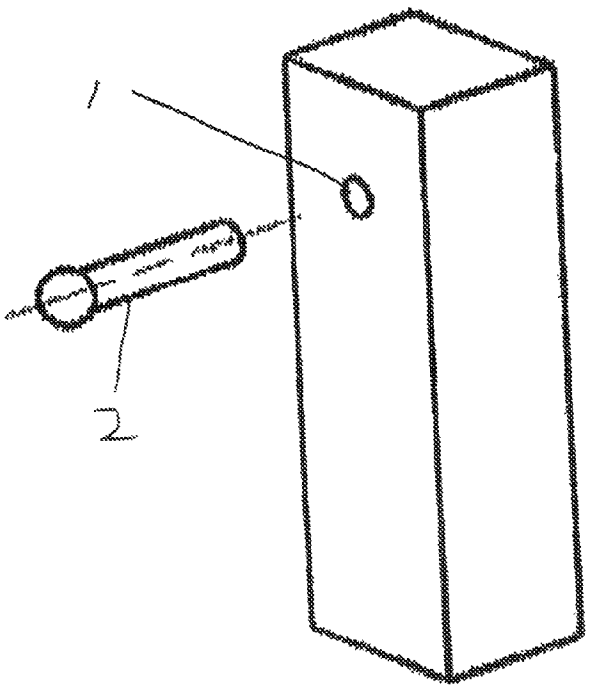
FIG. 5. Is an oblique and elevated view of the rigid, unmoving and upright post.
Figure 7:
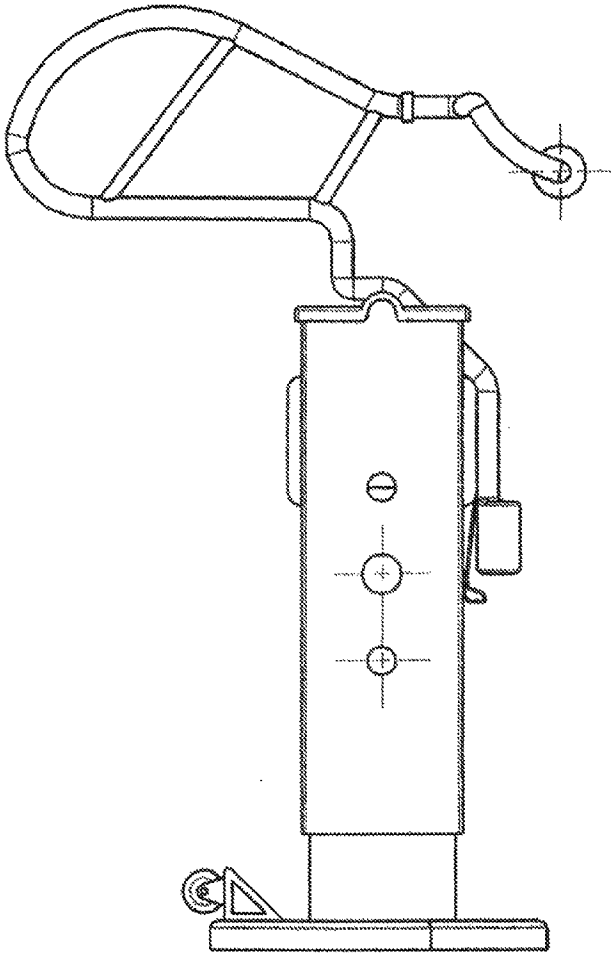
FIG. 7. Is a side view of the present invention in a height re-adjusted position.
Figure 7:
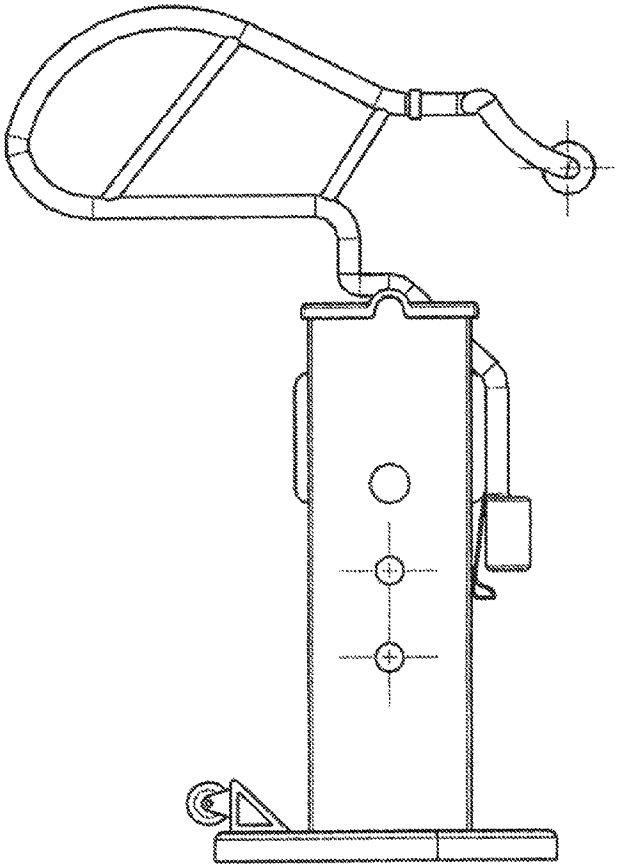
Figure 9:
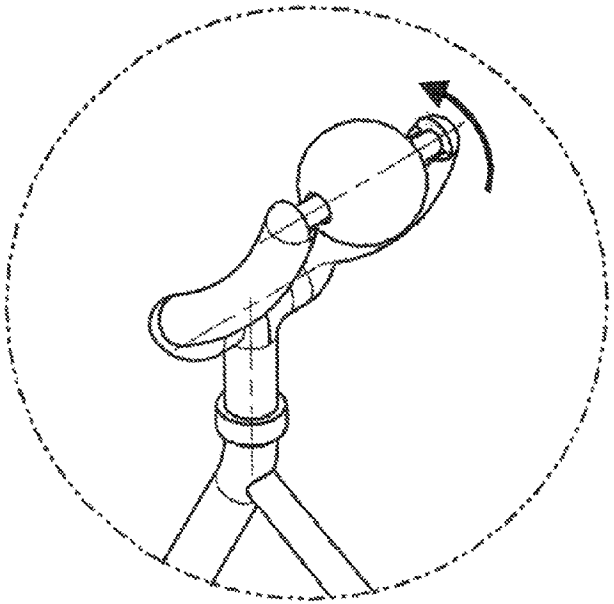
FIG. 9. Is a forward oblique elevated and blown-up view of the target unit ball and Y-shaped ball mounting unit.
Figure 8:
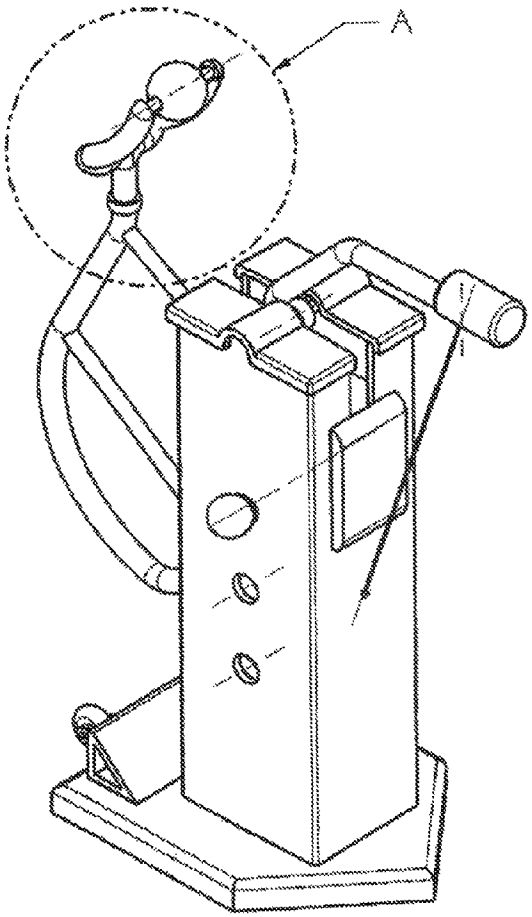
FIG. 8. Is a forward, oblique and elevated view of the present invention in the fully displaced position with particular notice to the connected Y-shaped ball mounting.

What I claim in my invention:

1. A training apparatus useful in practicing swinging at a ball comprising:

a) a base member having a first length, first width and first depth and being substantially parallel with a playing surface;

b) an upright post having a second length, a second width and a second depth and being substantially perpendicular to said base member;

c) a rigid hollow sleeve having a third length, a third width and a third depth and being substantially perpendicular to said playing surface and sliding over said upright post;

d) a rotatable tubular wand having a first end and second end bent roughly into the shape of a question mark (?); said wand mounted on the top crown of said hollow sleeve so that said wand can rotate along a predetermined longitudinal line;

e) a Y-shaped target unit ball mounting member having a first and second end wherein said second end is attached to the first end of said tubular wand;

f) a target unit ball attached to said ball mounting member g) a counterweight connected to the second end of said tubular wand;

h) a detachable resilient cord member that returns said tubular member to its original position upon said ball being struck by an independent racquet or bat and wherein said resilient cord member is connected to the said wand; and wherein upon said resilient cord member resetting said tubular wand member, only said counterweight maintains the said tubular wand member in its original orientation prior to being struck.

2. The device of claim 1 wherein the target unit ball is set on an easy spinning spindle, to be received onto a small through rod, that will allow the target unit ball to spin along a selected axis.

3. The device of claim 1 wherein the target unit ball having been placed on a spindle and appropriately mounted on a small through rod, the ball is mounted into the outwardly extending arms of the Y-shaped ball mounting unit.

4. The device of claim 1 wherein the said Y-shaped ball mounting unit second end is connected by insertion into the head of said question mark shaped wand, in a manner that will allow the angle of the axis of the ball to be selected by choice.

5. The device of claim 1 wherein there is at least one straight stabilizing member positioned within the inside circumference of said ?-shaped tubular member to reinforce and stabilize said member during use.

6. The device of claim 1 wherein the vertical height of the device is adjustable.

7. The device of claim 1 said tubular wand is made of plastic.

* * * * *